US009140067B2

(12) United States Patent
Crowley et al.

(10) Patent No.: US 9,140,067 B2
(45) Date of Patent: Sep. 22, 2015

(54) BRAKING MECHANISM FOR A DOWNHOLE TOOL

(71) Applicant: Smart Stabilizer Systems Limited, Ashchurch, Tewkesbury (GB)

(72) Inventors: Daniel Brendan Crowley, Gloucester (GB); Robert Donald John Sedgeman, Gloucester (GB)

(73) Assignee: Smart Stabilizer Systems Limited, Tewkesbury (GB)

( * ) Notice: Subject to any disclaimer, the term of this patent is extended or adjusted under 35 U.S.C. 154(b) by 37 days.

(21) Appl. No.: 13/759,629

(22) Filed: Feb. 5, 2013

(65) Prior Publication Data

US 2013/0199853 A1 Aug. 8, 2013

(30) Foreign Application Priority Data

Feb. 7, 2012 (GB) ..... 1202083.0

(51) Int. Cl.
*B60T 13/04* (2006.01)
*E21B 7/06* (2006.01)
*E21B 17/10* (2006.01)

(52) U.S. Cl.
CPC . *E21B 7/06* (2013.01); *E21B 7/062* (2013.01); *E21B 17/1014* (2013.01)

(58) Field of Classification Search
USPC ..... 188/82.1, 82.7, 82.77, 134, 135, 137, 188/166, 180, 182, 184, 185; 175/97, 98, 175/99, 325.3
See application file for complete search history.

(56) References Cited

U.S. PATENT DOCUMENTS

| | | | | |
|---|---|---|---|---|
| 2,719,007 | A * | 9/1955 | Arbogast | 237/9 R |
| 4,770,258 | A | 9/1988 | Falgout, Sr. | |
| 5,031,730 | A * | 7/1991 | Marion | 188/185 |
| 6,131,709 | A * | 10/2000 | Jolly et al. | 188/267.2 |
| 7,306,058 | B2 | 12/2007 | Cargill et al. | |
| 2003/0079913 | A1 | 5/2003 | Eppink et al. | |
| 2005/0241858 | A1 | 11/2005 | Eppink et al. | |
| 2006/0096786 | A1 | 5/2006 | Wells | |

FOREIGN PATENT DOCUMENTS

| | | |
|---|---|---|
| EP | 1024245 A2 | 8/2000 |
| EP | 1371810 | 12/2003 |

OTHER PUBLICATIONS

Search Report in corresponding Great Britain application No. GB1202083.0, dated Mar. 27, 2012, 1 page.

* cited by examiner

*Primary Examiner* — Thomas J Williams
(74) *Attorney, Agent, or Firm* — Blank Rome LLP

(57) ABSTRACT

This invention relates to braking mechanism for a downhole tool such as a steering tool. The braking mechanism comprises:

a body adapted for mounting upon the tool;

at least one braking member which is movably mounted upon the body;

a resilient biasing means biasing the braking member away from the body; and a damping mechanism connected to the braking member, the damping mechanism providing a damping force opposing movements of the braking member relative to the body, the damping force being dependent upon the rate of movement of the braking member.

19 Claims, 5 Drawing Sheets

BRAKING MECHANISM FOR A DOWNHOLE TOOL

CROSS REFERENCE TO RELATED APPLICATION

This Application claims priority to United Kingdom Patent Application No. GB1202083.0 filed 7 Feb. 2012, the contents of which are incorporated herein by reference.

FIELD OF THE INVENTION

This invention relates to braking mechanism for a downhole tool.

The braking mechanism has been designed for use primarily with a steering tool for a drill bit, and most of the following description relates to a steering tool. It will be understood from the following description that the braking mechanism acts to limit the rotation of a part of the steering tool about its longitudinal axis, and since this anti-rotation requirement is shared with other downhole tools it will be understood that the braking mechanism can also be used with those other downhole tools.

BACKGROUND TO THE INVENTION

A downhole steering tool (or "controllable stabiliser") is described in EP 1 024 245. As indicated in that document, the steering tool is used to control the drilling direction by forcing a part of the drillstring away from the longitudinal centreline of the borehole, thereby forcing the drill bit to deviate from a linear path. The steering tool of EP 1 024 245 carries a drive shaft which is connected to the drillstring and rotates with the drillstring, the drive shaft being surrounded by the annular steering tool. The steering tool has actuators which can move a part of the tool radially, and thereby move the drive shaft and drillstring away from the longitudinal centreline of the borehole.

In order to steer the drill bit in a chosen direction it is desirable that the steering tool does not rotate with the drillstring but instead only moves longitudinally along the borehole as the drill bit advances, maintaining a chosen orientation or azimuth within the borehole. However, there is a tendency for the steering tool to rotate with the drive shaft. It is therefore known to provide a braking mechanism which can engage the borehole wall in order to reduce the rotation of the steering tool.

It is recognised that the braking mechanism will not always prevent rotation of the steering tool within the borehole, and the tool contains sensors to detect its actual azimuth (as well as its inclination and toolface) so as to ensure accurate control of the steering direction. Nevertheless, it is intended that the braking mechanism significantly reduces the rate of rotation of the steering tool.

Ideally, the braking mechanism should provide a minimum resistance to the continued advance of the steering tool and therefore the drill bit during the drilling operation, and should provide a minimum resistance to the longitudinal movement of the steering tool during tripping of the downhole assembly.

A known braking mechanism used on practical embodiments of the steering tool of EP 1 024 245 includes a torsion beam and is often referred to as an "anti-rotation lever". The braking mechanism has a braking member in the form of a metal blade which is designed to engage the borehole wall, the blade lying in a plane which is substantially radial to the steering tool and substantially parallel to the longitudinal axis of the steering tool. When the blade engages the borehole wall (and perhaps digs into the borehole wall), it provides minimum resistance to longitudinal movement of the steering tool, but provides maximum resistance to rotation of the steering tool (around the longitudinal axis of the steering tool).

The blade is mounted at one end of the torsion beam, the other end of which is securely fixed to the steering tool. The torsion beam provides a flexible but resilient connection between the steering tool and the blade, and in its rest condition causes the blade to project beyond the periphery of the steering tool. In practical applications there are typically three or six braking mechanisms spaced approximately 120° or approximately 60° apart, respectively, around the circumference of the steering tool, each of the blades being biased to project a predetermined distance (usually a few millimeters) beyond the tool periphery. It is arranged that the drill bit produces a borehole which is nominally only slightly larger than the steering tool, i.e. the radial gap between the borehole wall and the steering tool is substantially less than the radial protrusion of the blades in their rest condition, so that in use the blades adopt a nominal position in which they are substantially continuously pressed against the borehole wall as the drill bit advances.

It is a known problem with downhole tools that the radial distance within which componentry can be located is relatively small. Thus, all downhole tools must accommodate a bore through which drilling mud can be communicated to the drill bit, and at least one peripheral channel through which drilling mud and entrained drill cuttings can be returned to the surface. A steering tool such as EP 1 024 245 in particular presents significant space limitations in that the tool must have a large enough bore to accommodate the drive shaft (with its own bore for the drilling mud), as well as all of the componentry needed to control and move the actuators. In practice, the radial size of the steering tool within which the braking mechanism and other componentry can be mounted is often only a few centimeters.

Another braking mechanism for a downhole steering tool (referred to as an "anti-rotation device") is described in U.S. Pat. No. 7,306,058. The first embodiment of this document discloses a number of rollers mounted upon a carriage, the axis of rotation of the rollers being tangential to the steering tool so that the rollers can roll along the borehole wall as the drill bit advances, and resist rotational movement of the steering tool. The carriage is biased outwardly of the steering tool by a set of coil springs.

The second embodiment uses a number of pistons which are driven outwardly of the steering tool (and into engagement with the borehole wall) by coil springs acting in cooperation with pneumatic or hydraulic pressure acting underneath the pistons.

The downhole environment in which a steering tool must operate is extremely harsh, including substantial pressures and very high temperatures. There is therefore an advantage in providing a braking mechanism which is mechanically simple and is therefore less likely to fail in use. Mechanically simple braking mechanisms such as the torsion beam described above are therefore in widespread use.

The force which can be provided by the known braking mechanisms is significant. The torsion beams used in the steering tool of EP 1 024 245 for example are designed to exert a force of 600-700 N on the borehole wall. Such forces contribute towards the harsh environment and can cause damage to the steering tool in the event that the borehole wall contains discontinuities such as voids which can cause a rapid change in the diameter of the borehole (and therefore a rapid extension and subsequent retraction of the blades). Since the borehole wall will seldom be smooth and of uniform diameter throughout its length, the steering tool must be able to accommodate the mechanical shocks caused by rapid movements of the blades as they move along the borehole wall.

In addition to their mechanical simplicity, torsion beam braking mechanisms require relatively little radial space in which to operate, and are therefore useful in a steering tool where the radial space is limited. However, they have the disadvantage that they require significant longitudinal space, i.e. the torsion beam is relatively long. This places limitations upon the location of the braking mechanism upon the steering tool. In addition, since the braking mechanism must be positioned upon a linear section of the steering tool, the length of the torsion beam contributes towards the minimum possible length of the steering tool. It will be understood that a long steering tool cannot pass along a sharply curved section of borehole, and steering tool designers are seeking to provide shorter steering tools which place a higher limit upon the possible borehole curvature.

SUMMARY OF THE INVENTION

The inventor has sought to reduce or avoid the drawbacks of the known braking mechanisms, particularly for use with downhole steering tools.

According to the invention there is provided a braking mechanism for a downhole tool, the braking mechanism having:

a body adapted for mounting upon the tool;

at least one braking member which is movably mounted upon the body;

a resilient biasing means biasing the braking member outwardly of the body; and a damping mechanism connected to the braking member, the damping mechanism providing a damping force opposing movements of the braking member relative to the body, the damping force being dependent upon the rate of movement of the braking member.

Accordingly, the damping mechanism is "rate sensitive", the damping force increasing with the rate of movement of the braking member. The greater the rate of movement of the braking member the larger the damping force, and therefore the greater the resistance to movement of the braking member. Alternatively stated, slow movements of the braking member will result in a small damping force. If the slow movement of the braking member is in the direction towards the body, the movement will be resisted almost totally by the resilient biasing means. On the contrary, rapid movements of the braking member will result in a large damping force. The damping force can significantly exceed the force of the resilient biasing means so that rapid movements can be resisted almost totally by the damping mechanism.

The braking mechanism of the present invention therefore has considerable benefits over a braking mechanism relying upon a resilient biasing means alone. In arrangements relying upon a resilient biasing means alone there is a compromise between providing a large biasing force which can resist rapid or high frequency movements (which are usually the most damaging to the tool), and providing a small biasing force which provides less resistance to the advance and tripping of the drill bit.

The present invention avoids this compromise and can utilise a relatively small resilient biasing force which minimises the resistance to the advance and tripping of the drill bit, and yet in the presence of rapid or high frequency movements allows the steering tool to behave as if the braking mechanism is substantially rigid, reducing the likelihood that the tool is required to withstand potentially destructive mechanical shocks.

Preferably, the damping mechanism is hydraulic, the body having a fluid conduit including a cylinder, the braking member being connected to a piston which is movably located within the cylinder, the fluid conduit including at least one damping member. Movement of the braking member is communicated to the piston which forces fluid to flow along the conduit and past the damping member. The damping member restricts the flow of fluid along the conduit. Slow movements of the braking member can readily be accommodated by the movement of hydraulic fluid along the fluid conduit and past the damping member, whereas rapid movements of the braking member cannot be accommodated and the damping member effectively holds the piston against movement within the cylinder, and consequently prevents movement of the braking member.

Preferably, the resilient biasing means is at least one compression spring. Preferably there are two compression springs providing a balanced biasing force upon the braking member. The use of compression springs instead of a torsion beam allows a reduction in the length of the braking mechanism, enabling the designer to more easily package the braking mechanism within the tool, and avoiding the contribution of the braking mechanism to the length of the tool.

It will be understood that the damping mechanism absorbs energy from the moving braking member. The packaging benefit of using compression springs can enable a tool designer to use multiple braking mechanisms around and along the tool so as to increase the energy dissipation capacity of the system.

Desirably, the fluid conduit is connected to a second cylinder which accommodates a balancing piston. Desirably also, the drive piston and the balancing piston are located at opposed ends of the fluid conduit, with the damping member located therebetween. It will be understood that the fluid between the drive piston and the balancing piston is incompressible, so that movements of the drive piston within its cylinder (corresponding to movements of the braking member) are communicated to the balancing piston by way of the damping member.

The drive piston and the balancing piston are preferably sealed to the fluid conduit so that they enclose a volume of hydraulic fluid therebetween. The hydraulic fluid is thereby isolated from the fluid within the borehole. The balancing piston compensates for thermal expansion of the hydraulic fluid during use.

Desirably, the side of the balancing piston which does not face the drive piston is exposed to the pressure within the borehole. Desirably also, the balancing piston's cylinder is located adjacent to the edge of the body of the braking mechanism, and the body has at least one opening through which borehole fluid can enter the cylinder. This ensures that the pressure of the hydraulic fluid within the fluid conduit closely matches the pressure of the fluid within the borehole, minimising the likelihood of leaks from or into the fluid conduit and thereby minimising the chances of contaminating the hydraulic fluid with borehole fluid.

Preferably, the damping mechanism is variable, whereby the damping force resulting from a particular rate of movement of the braking member can be varied to suit the tool requirements. The variability of the damping mechanism can be provided by interchangeable damping members, i.e. the damping member can comprise a valve with an orifice, and a chosen one of a number of different valves (with differing orifice sizes) can be fitted into the fluid conduit as required. In an alternative and more complex embodiment the damping member can comprise a needle valve, the needle being movable towards and away from an orifice whereby to increase and decrease the resistance to fluid flow respectively. The damping characteristics of the alternative embodiment can be varied in use by suitable downhole control means if desired, although such complexity is expected to be rarely required in practice.

In alternative embodiments the damping mechanism includes a magnetorheological fluid within the fluid conduit, and an electrical coil to produce a magnetic field within part of the fluid conduit. A magnetorheological fluid typically comprises ferromagnetic or paramagnetic particles suspended in a carrier fluid such as oil. In the absence of a magnetic field the particles flow readily with the carrier fluid and the fluid has a relatively low viscosity. In the presence of a magnetic field the particles adhere together (usually in the form of chains) within the fluid, thereby significantly increasing the viscosity of the fluid. The viscosity of the fluid can therefore be altered by the magnetic field, and the damping force which is provided can be varied. It can for example be arranged that the movement of the braking member acts to generate the electrical current, so that the greater the rate of movement of the braking member the larger the electrical current and the larger the magnetic field, thereby increasing the damping force provided by the magnetorheological fluid.

It will be understood that other forms of damping could be used if desired, such as viscoelastic damping for example, either alone or in combination with the described hydraulic damping mechanisms.

BRIEF DESCRIPTION OF THE PREFERRED EMBODIMENTS

The invention will now be described in more detail, by way of example, with reference to the accompanying drawings, in which.

DETAILED DESCRIPTION OF THE INVENTION

Figure 1:
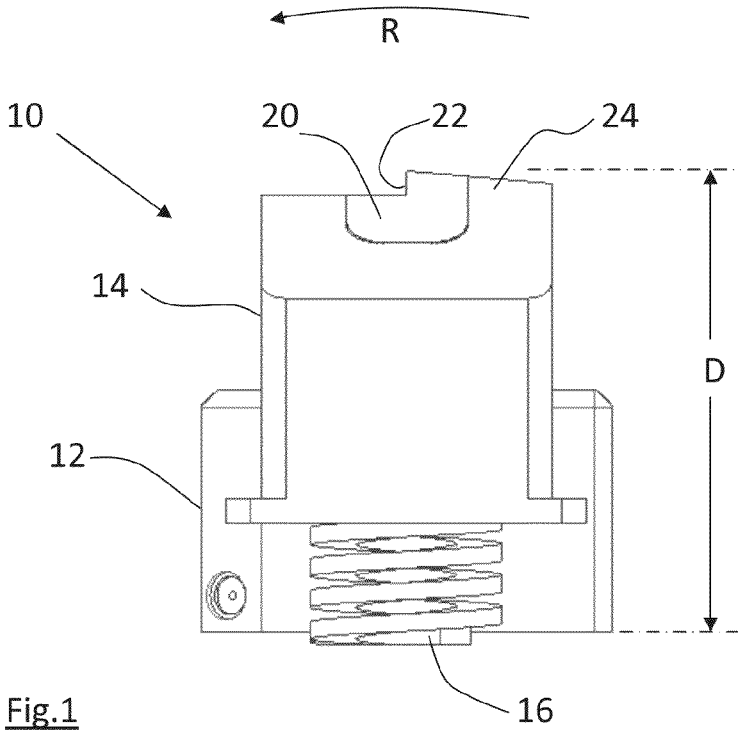
FIG. 1 shows an end view of the braking mechanism of the present invention.
Figure 2:
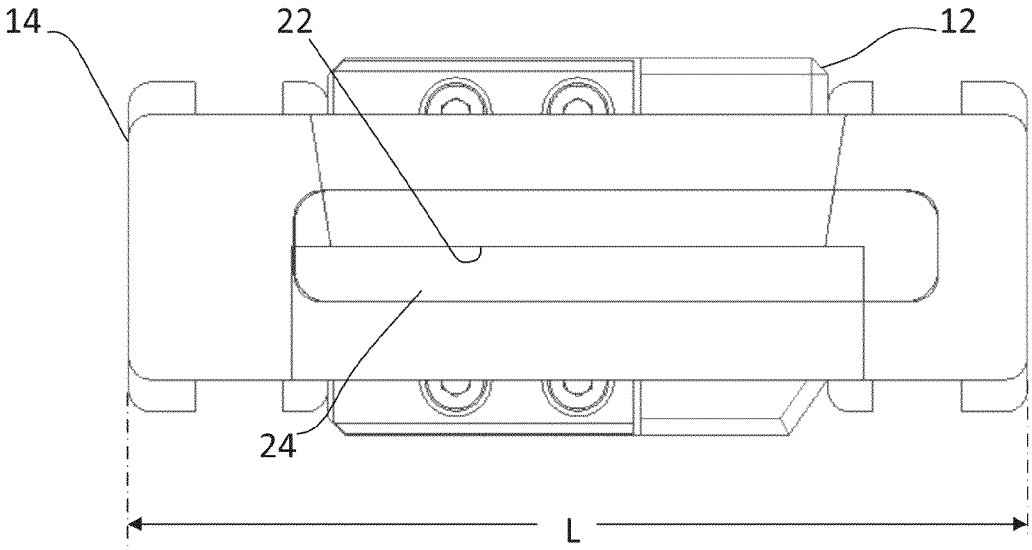
FIG. 2 shows a plan view of the braking mechanism.
Figure 3:
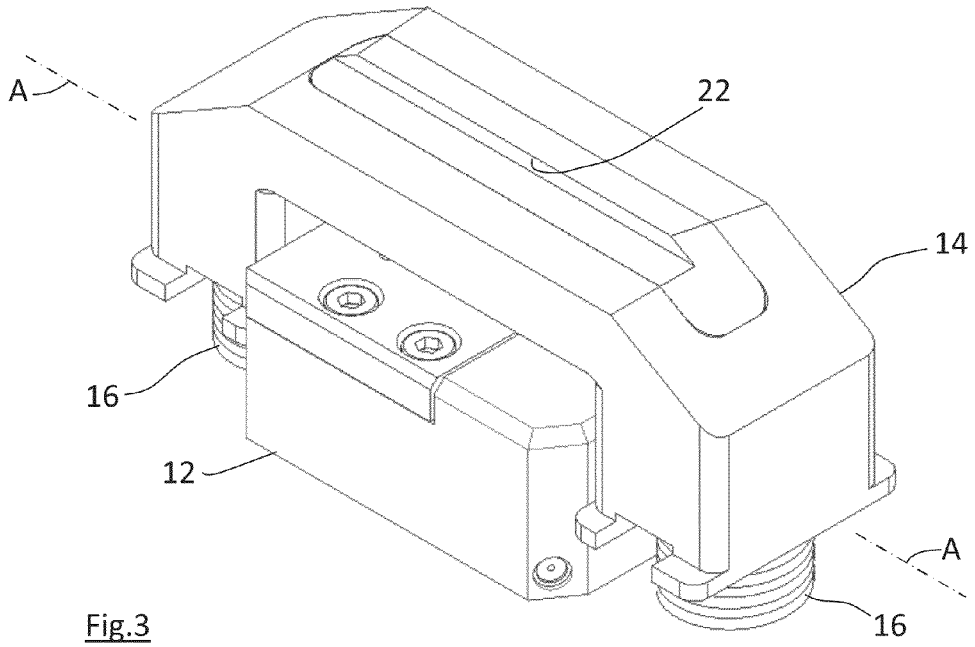
FIG. 3 shows a perspective view of the braking mechanism.

It will be understood that the body of the braking mechanism shown in FIGS. 7-10 of the drawings has been made partially transparent so that the internal components are visible, for ease of understanding.

The braking mechanism 10 shown in FIGS. 1-5 comprises a body 12 and a bridge 14 which is carried by, and spans, the body 12. In use the bridge 14 is biased (upwardly as drawn in FIGS. 1 and 4) by two compression springs 16.

The bridge 14 is metallic and carries a metallic insert 20. The insert 20 is made of particularly hard material such as tungsten carbide, whereby to resist erosion when in contact with the borehole wall (not shown) in use.

The insert 20 has a step which creates a braking member or blade 22. It will be understood that the braking mechanism 10 is mounted upon the downhole tool in a position in which the blade 22 lies in a plane which is substantially radial to the longitudinal axis A-A of the tool and substantially parallel to the longitudinal axis A-A. In use upon a steering tool such as that of EP 1 024 025, it will also be understood that as the drive shaft rotates within the steering tool, there is a tendency for the steering tool to rotate with the drive shaft around the longitudinal axis A-A in the direction R shown in FIG. 1. The blade 22 engages the borehole wall in known fashion (and may dig into the borehole wall) and resists the induced rotation of the steering tool.

One compression spring 16 is located at either end of the bridge 14. The compression springs 16 provide substantially equal force whereby they provide a substantially balanced force upon the bridge 14, i.e. the biasing forces measured at either end of the bearing surface 24 are substantially identical.

Figure 4:
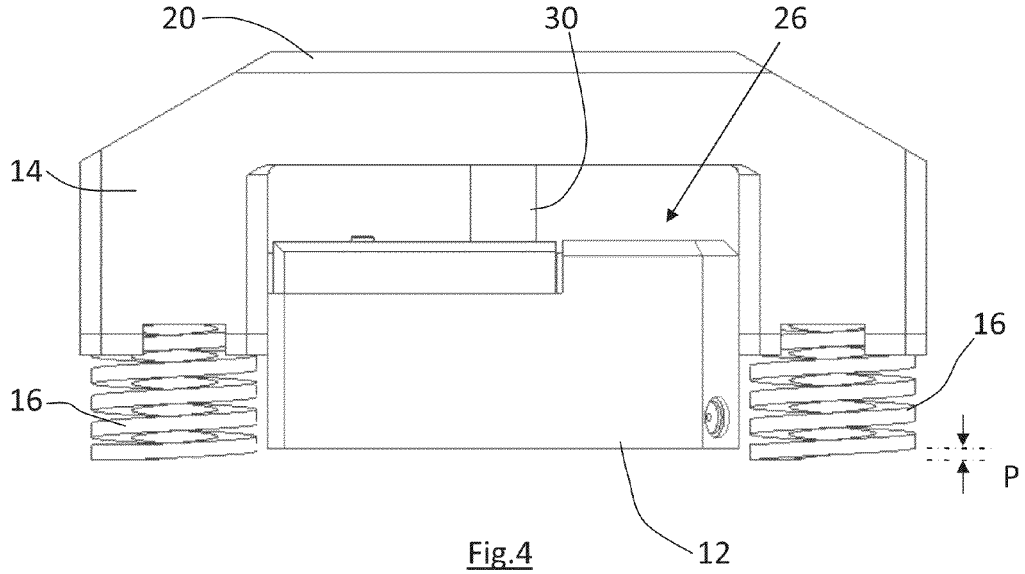
FIG. 4 shows a side view of the braking mechanism.
Figure 5:
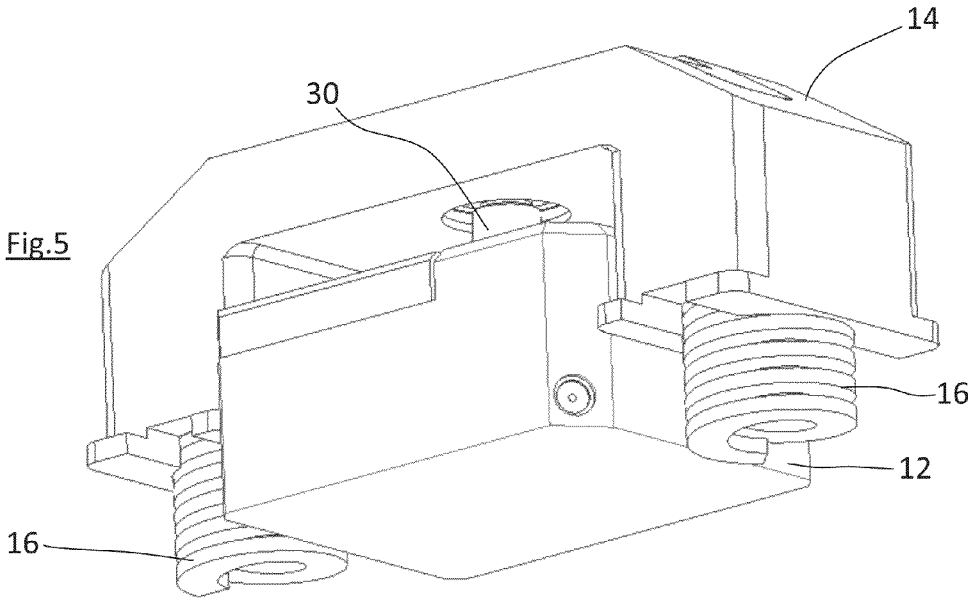
FIG. 5 shows an underside perspective view of the braking mechanism.
Figure 7:
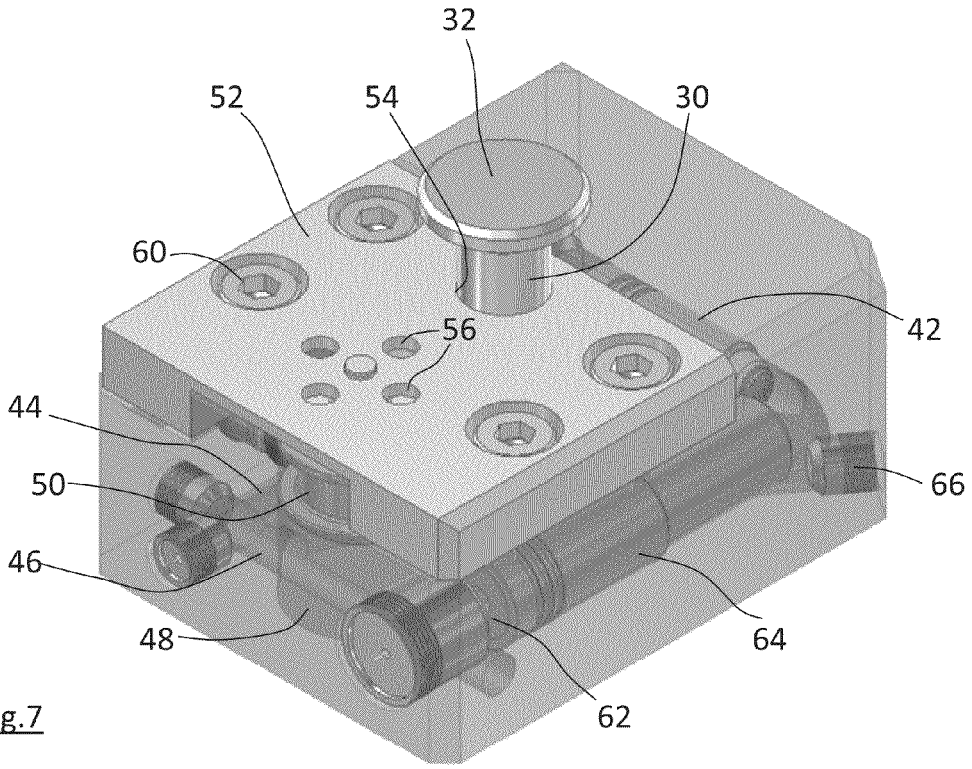
FIGS. 7-10 show various perspective views of the body of the braking mechanism.
Figure 8:
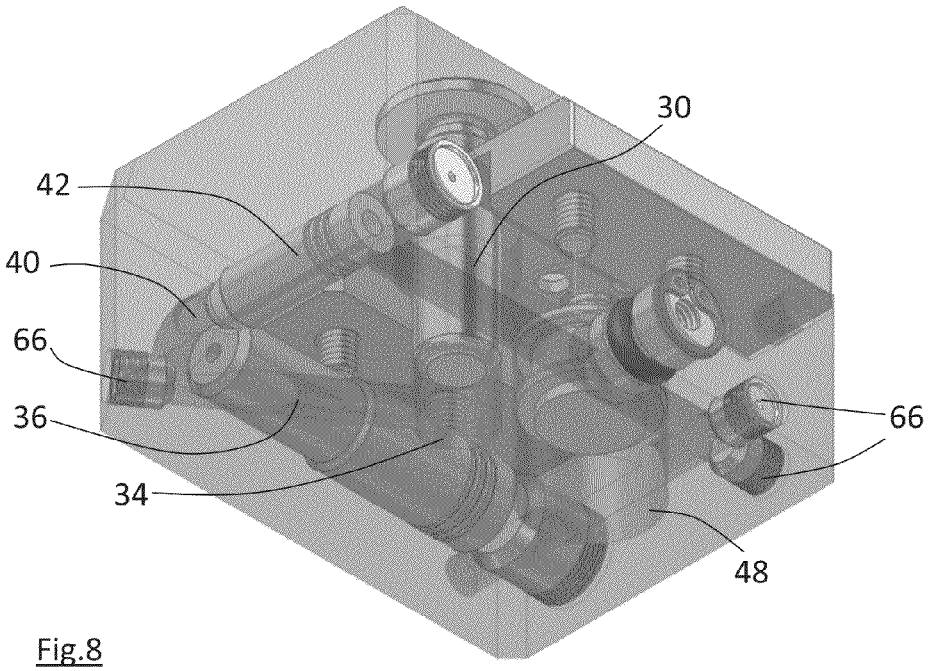
Figure 9:
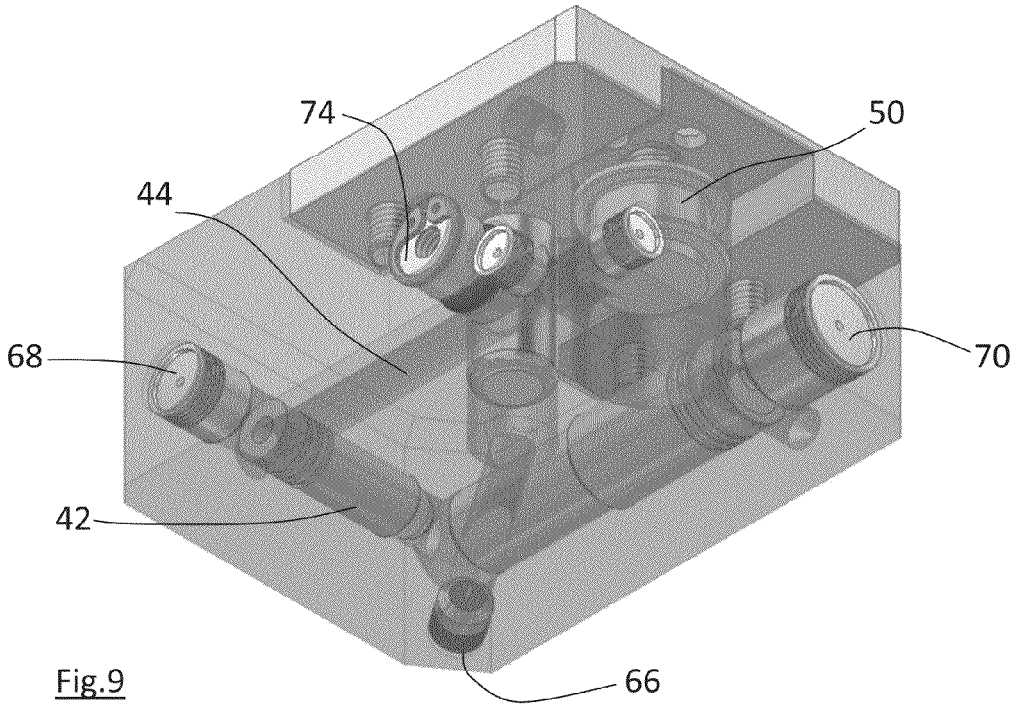
Figure 10:
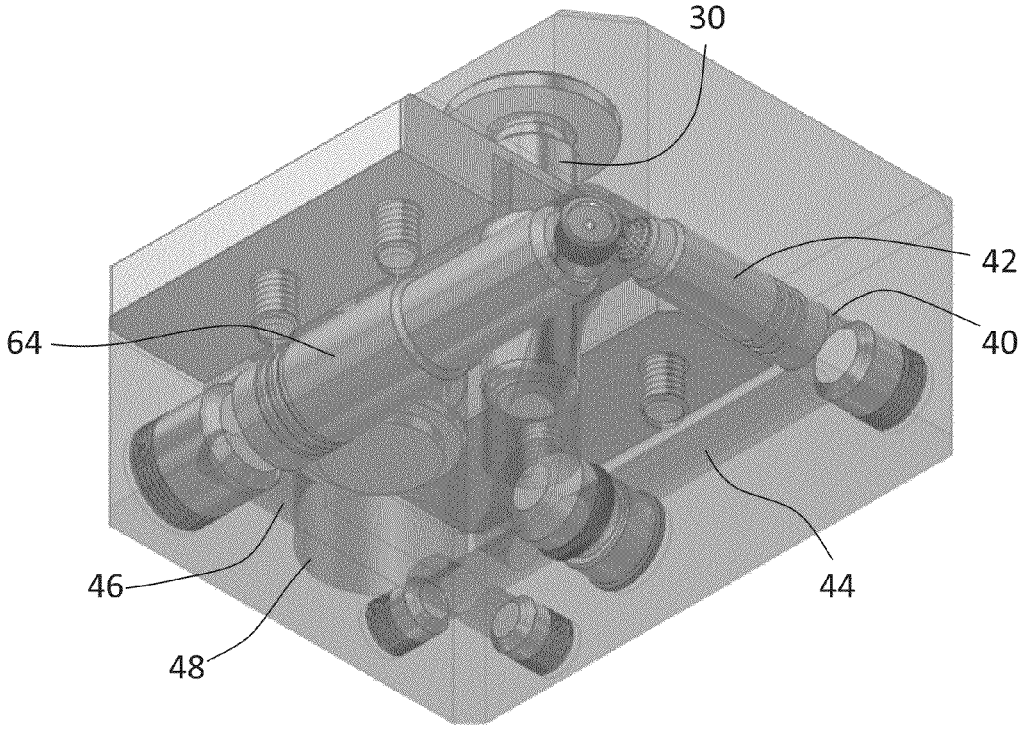

The bridge 14 is connected to the body 12 by a drive piston 30 (a part of which is visible in the side view of FIG. 4). As shown in FIG. 7 in particular, the drive piston 30 has an enlarged piston head 32 which locates within a closed channel (not shown) in the bridge 14. In this way, bi-directional movements (up and down as viewed in FIGS. 1 and 4) of the bridge 14 are communicated to the drive piston 30, and vice versa.

FIG. 4 shows the fully extended position of the piston 30, i.e. the blade 22 is at its furthest possible distance from the body 12. It will be seen that the compression springs 16 nevertheless project by a small distance P below the bottom of the body 12, so that the compression springs 16 must be compressed slightly as the braking mechanism 10 is mounted into its well or recess (not shown) in the downhole tool (also not shown). The projecting distance P results in a preloading force for the braking mechanism 10 when the bridge 14 is at its maximum extension as shown in FIG. 4, the preloading force being variable as desired by varying the projecting distance P.

In common with prior art braking mechanisms, the braking mechanism 10 is designed so that the braking member 22 can extend further than the space available within a correctly-sized borehole, so that the compression springs 16 will in practice be further compressed when the braking member is in its nominal position. The preloading of the compression springs permits the use of lower-rated springs which are nevertheless able to provide the biasing force required at the braking member's nominal position, and provide a better range of biasing forces throughout the range of movement of the braking member.

It will be understood that the bridge 14 can be moved downwardly as drawn from the position shown in FIG. 4, and in some embodiments the underside of the bridge can engage the top of the body. The nominal position for the bridge 14, i.e. the position it adopts when in a correctly-sized borehole, will lie between its two extremes, so that the braking member 22 is able to move outwardly and inwardly relative to the tool in response to deviations in the borehole diameter.

The drive piston 30 is located within a cylinder 34 formed into the body 12 of the braking mechanism 10.

Figure 6:
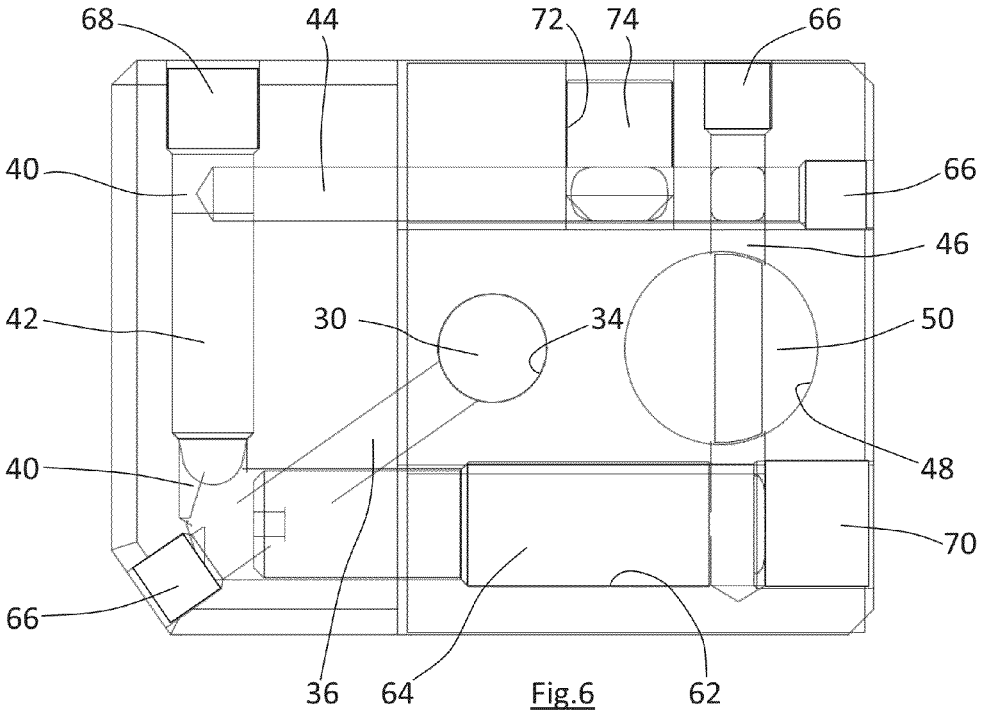
FIG. 6 shows a sectional view from above of the body of the braking mechanism.

As shown in particular in the sectional view of FIG. 6, the cylinder 34 is connected to a first part 36 of a fluid conduit. The first part 36 of the fluid conduit is connected to a second part 40 of the fluid conduit.

The second part 40 of the fluid conduit contains a damping member or flow control valve 42. The damping member 42 comprises an insert within the second part 40 of the fluid conduit, the damping member 42 providing the greatest restriction to the flow of hydraulic fluid along the fluid conduit. Specifically, the damping member is hollow whereby hydraulic fluid can flow therethrough, but the cross-sectional area of the hollow opening within the damping member is smaller than all other parts of the fluid conduit. In alternative embodiments, the damping member can contain baffles or other flow limiting means whereby the hydraulic fluid is forced to undertake a circuitous path through the damping member.

In this preferred embodiment the damping member 42 restricts the flow in both directions along the fluid conduit 40 to the same degree, i.e. the damping force upon the piston 30 is the same whether the piston 30 is moving inwardly or outwardly of its cylinder 34. In other embodiments the damping member is arranged to provide a larger damping force when the piston is moving outwardly of its cylinder than when it is moving inwardly, to compensate for the biasing force of the compression springs 16. In both cases, the damping member 42 provides only a small damping force, i.e. only a small restriction in the fluid flow rate, when the piston 30 is moving slowly, and a large damping force when the piston 30 is moving rapidly.

The second part 40 of the fluid conduit is connected to a third part 44 of the fluid conduit, which is in turn connected to a fourth part 46 of the fluid conduit. The fourth part 46 of the fluid conduit is connected to a cylinder 48 of a balancing piston 50.

As seen in FIG. 7, the top cover 52 of the body 12 has a primary opening 54 which accommodates the drive piston 30. The top cover has a number of secondary openings 56 which communicate with the cylinder 48 of the balancing piston 50. Accordingly, one side of the balancing piston 50 is exposed to the hydraulic fluid within the fluid conduit, whereas the other side of the balancing piston 50 is exposed to the fluid within the borehole. This enables the pressure within the fluid conduit to closely match the pressure within the borehole and reduces the likelihood of leaks.

It will be understood that as the drive piston 30 moves relative to its cylinder 34, the fluid within the fluid conduit 36, 40, 44, 46 causes those movements to be matched by corresponding movements of the balancing piston 50, and the consequent introduction or expulsion of borehole fluid through the openings 56.

The top cover 52 is secured to the remainder of the body 12 by four bolts 60.

In order to reduce the likelihood of leaks within the body 12, a pressure relief conduit 62 (FIG. 7) is formed within the body 12, directly connecting the first part 36 of the fluid conduit to the fourth part 46 of the fluid conduit. A pressure relief valve 64 is located in the conduit 62. The pressure relief valve 64 will only permit fluid flow along the pressure relief conduit 62 in the event that the pressure within the fluid conduit reaches a predetermined threshold (which is arranged to be slightly below the pressure which the designers have calculated (or tested) to cause leaks from the fluid conduit). Under extreme pressures above the predetermined threshold, the pressure relief valve 64 allows hydraulic fluid to flow between the drive piston 30 and the balancing piston 50, bypassing the damping member 42. During periods of extreme pressure, therefore, the movements of the blade 22 are substantially undamped.

The pressure relief valve 64 is designed to close the pressure relief conduit 62 when the pressure drops below the threshold so that damping of the movements of the blade 22 is resumed.

The first part 36, second part 40, third part 44 and fourth part 46 of the fluid conduit are produced by respective drillings into the body 12, the drillings being subsequently sealed by respective blanking plugs 66, 68. The pressure relief conduit 62 is formed by a separate drilling which is subsequently sealed by a blanking plug 70. The blanking plug 68 is larger than the blanking plugs 66 since the diameter of the second part 40 of the fluid conduit is larger than the diameter of the first part 36, third part 44 and fourth part 46, in order to accommodate the damping member 42.

A filling conduit 72 is drilled into the body 12, the filling conduit 72 communicating with the third conduit 44 and being provided for filling the fluid conduit with hydraulic fluid. The filling conduit is sealed by a plug 74 after the fluid conduit has been filled with hydraulic fluid.

It will be understood that the braking mechanism is relatively small. The depth D of the braking mechanism 10 is approximately 38 mm, and is sufficiently small that it can be accommodated within commercial embodiments of the steering tool of EP 1 024 245 for example.

In addition, the length L is approximately 81 mm, and is therefore considerably shorter than an equivalent torsion beam braking mechanism. This gives a steering tool designer much greater freedom to locate the braking mechanism 10 at a desired location upon the steering tool. For example, a set of three braking mechanisms 10 may be located (spaced approximately 120° apart around the circumference of the steering tool) adjacent either end of the steering tool. In contrast, space constraints require that the existing torsion beam braking mechanisms must be fitted adjacent to the centre of the steering tool. The steering tool designer can therefore fit twice as many of the present braking mechanisms to the steering tool, if desired. Also, fitting the braking mechanisms 10 adjacent to the ends of the steering tool has packaging benefits in that there is usually more radial space available at those locations than at the centre of the steering tool.

Despite the relatively small size of the braking mechanism 10, the two compression springs 16 can together provide the biasing force of around 600-700 N, and the braking mechanism 10 can have a stroke of around 6 mm, therefore matching the performance of the known torsion beam braking mechanisms. However, if the tool designer wishes to take advantage of the packaging benefits and locate the braking mechanisms in locations with increased radial space, the designer can utilise longer springs 16 and a longer piston 30 whereby to increase the available stroke of the blade 22.

Despite the general desire to make downhole tools mechanically simple, and therefore less liable to fail in the harsh environment of a borehole, the inventor has realised that it is nevertheless possible to incorporate damping into the braking mechanism whereby to avoid or reduce the drawbacks of the existing braking mechanisms, and yet without introducing significant mechanical complexity into the tool. In particular, the braking mechanism 10 of the present invention can be made sufficiently robust and reliable to withstand up to $10^6$ cycles of extension and retraction, which is believed to be sufficient to exceed the lifetime of the insert 20, i.e. it is intended that the insert 20 will wear down and require replacement before the damping mechanism fails.

The invention claimed is:

1. A braking mechanism for a downhole tool, the braking mechanism having:

a body adapted for mounting upon the tool;

at least one braking member which is movably mounted upon the body, the braking member being movable relative to the body continuously during use, the braking member being movable both towards and away from the body;

a resilient biasing element biasing the braking member away from the body; and a damping mechanism connected to the braking member, the damping mechanism providing a damping force opposing movement of the braking member towards the body, the damping force being dependent upon the rate of movement of the braking member.

2. A braking mechanism according to claim 1 in which the damping mechanism is hydraulic, the body having a fluid conduit including a cylinder, the braking member being connected to a drive piston which is movably located within the cylinder.

3. A braking mechanism according to claim 2 in which the fluid conduit includes at least one damping member which restricts the flow of fluid along the conduit.

4. A braking mechanism according to claim 2 in which the damping mechanism includes a magnetorheological fluid within the fluid conduit, and an electrical coil to produce a magnetic field within part of the fluid conduit.

5. A braking mechanism according to claim 1 in which the damping mechanism is variable.

6. A braking mechanism according to claim 5 in which the variability of the damping mechanism is provided by interchangeable damping members.

7. A braking mechanism according to claim 1 in which the damping force is dependent upon the direction of movement of the braking member.

8. A braking mechanism according to claim 1 in which a damping force is applied when the braking member moves both towards and away from the body.

9. A braking mechanism according to claim 1 in which the resilient biasing element provides a preloading biasing force upon the braking member.

10. A braking mechanism according to claim 1 in which the resilient biasing element is at least one compression spring.

11. A braking mechanism according to claim 1 in which the braking member is mounted upon a support member which is movable relative to the body.

12. A braking mechanism according to claim 11 in which the support member is a bridge spanning the body.

13. A braking mechanism according to claim 12 in which the resilient biasing element comprises two compression springs, one compression spring being located at each end of the bridge, the two compression springs providing similar biasing forces upon the bridge.

14. A braking mechanism for a downhole tool, the braking mechanism having:

a body adapted for mounting upon the tool;

at least one braking member which is movably mounted upon the body;

a resilient biasing element biasing the braking member away from the body; and a damping mechanism connected to the braking member, the damping mechanism providing a damping force opposing movements of the braking member relative to the body, the damping force being dependent upon the rate of movement of the braking member, wherein the braking member is mounted upon a bridge which spans the body and is movable relative to the body, wherein the resilient biasing element comprises two compression springs, one compression spring being located at each end of the bridge, the two compression springs providing similar biasing forces upon the bridge, and wherein, in their relaxed state, the compression springs project beyond the body.

15. A braking mechanism for a downhole tool, the braking mechanism having:

a body adapted for mounting upon the tool;

at least one braking member which is movably mounted upon the body;

a resilient biasing element biasing the braking member away from the body; and a damping mechanism connected to the braking member, the damping mechanism providing a damping force opposing movements of the braking member relative to the body, the damping force being dependent upon the rate of movement of the braking member, wherein the damping mechanism is hydraulic, the body having a fluid conduit including a cylinder, the braking member being connected to a drive piston which is movably located within the cylinder, and wherein the fluid conduit is connected to a second cylinder which accommodates a balancing piston.

16. A braking mechanism according to claim 15 in which the drive piston and the balancing piston are located at opposed ends of the fluid conduit, with the damping mechanism located therebetween.

17. A braking mechanism according to claim 15 in which the drive piston and the balancing piston are sealed to the fluid conduit so that they enclose a volume of hydraulic fluid therebetween.

18. A braking mechanism according to claim 17 in which the side of the balancing piston which does not face the drive piston is exposed to the pressure outside the body.

19. A braking mechanism according to claim 18 in which the second cylinder is located adjacent to the edge of the body, the body having at least one opening through which, in use, fluid can enter the second cylinder from outside the body.

* * * * *